United States Patent [19]

Jensen et al.

[11] 3,990,038

[45] Nov. 2, 1976

[54] ELECTRON BEAM SOURCE OF NARROW ENERGY DISTRIBUTION

[75] Inventors: Arthur S. Jensen; Clarence Williams, both of Baltimore, Md.

[73] Assignee: Westinghouse Electric Corporation, Pittsburgh, Pa.

[22] Filed: May 7, 1973

[21] Appl. No.: 357,976

[52] U.S. Cl. ..... 315/17; 313/423; 313/365; 313/395; 315/10

[51] Int. Cl.[2] ..... H01J 29/84; H01J 29/58; H01J 31/12; H01J 31/28

[58] Field of Search ..... 315/10–12, 315/21, 15, 16, 17; 313/423

[56] References Cited

UNITED STATES PATENTS

| | | | |
|---|---|---|---|
| 2,916,664 | 12/1959 | Sternglass | 315/12 |
| 3,003,110 | 10/1961 | Toulemonde | 315/12 |

*Primary Examiner*—Maynard R. Wilbur
*Assistant Examiner*—David Leland
*Attorney, Agent, or Firm*—W. G. Sutcliff

[57] ABSTRACT

An electron source is disclosed for generating a flow of electrons of substantially narrow energy distribution. Such a source may be incorporated into a cathode ray tube (CRT) where the beam of narrow energy electrons is modulated, as by a grid or other target element of the CRT; the current control characteristics of the CRT are dependent upon the energy distribution of the electron beam, and as the width of this distribution in the beam or flow of electrons is decreased, the sensitivity of the CRT is increased. In accordance with the teachings of this invention, the electron beam source includes a mirror element for critically absorbing incident electrons whose energy is above a predetermined value. Electrons whose energy is below the critical predetermined value are reflected from the mirror element to form an electron flow of a substantially uniform energy level. In an illustrative embodiment of this invention, the mirror element comprises a support layer upon which there is disposed a material, such as gold black, deposited in a smoke form and having a low secondary electron emission ratio. The critical predetermined value is related to the voltage difference between the cathode element for generating the electrons and the mirror element; this voltage difference is set to determine the energy level of those electrons reflected from the mirror element. Significantly, the electron source of this invention is capable of providing either a narrow or pencil beam of electrons, or a flood beam of electrons of substantially uniform energy.

10 Claims, 8 Drawing Figures

ELECTRON BEAM SOURCE OF NARROW ENERGY DISTRIBUTION

BACKGROUND OF THE INVENTION

1. Field of the Invention

This invention relates to sources of electrons and in particular, to such sources adapted for use in cathode ray tube devices, wherein a beam of electrons is modulated by a target or grid element therein.

2. Description of the Prior Art

There are a great variety of cathode ray tubes (CRT's), such as image conversion tubes, display storage tubes, information storage tubes and image correlation tubes, wherein a flow or beam of electrons is modulated by a grid or target element. For example, in a display storage tube, a video image is stored first upon a grid in the form of an array of discrete charges which serves to modulate or control a flood beam of electrons that is directed through the grid. The modulated flood beam of electrons then is directed onto a phosphor screen to provide thereby a visual display of the stored electron image. The grid of a storage display tube may be of large area and have a high transverse resistance. As a result, the grid may store a pattern of voltages thereon so that its control varies with position in the electron image. Significantly, the performance of such a display storage tube depends upon the energy distribution of the electron beam that is to be modulated or controlled by the grid. In particular, the current control characteristics, i.e. the electron beam current versus voltage of the modulating target or grid element, has a slope or transconductance $g_m$ that depends upon the energy distribution of the electron beam and the size of the holes or slots of the grid through which the electron beam is directed. This slope is a measure of the sensitivity of the storage display tube or other CRT device. For example, a grid or target element may have a pattern of voltage charges stored thereon which serves to control or modulate a beam of electrons. The sensitivity of the CRT incorporating such a grid or target element may be thought of in terms of the smallest voltage difference of the charge stored on the target element that may be detected by an electron beam. Typically, that incremental portions of the electron beam are modulated by the voltage imposed upon the CRT grid and the degree of modulation is dependent upon the width of the energy distribution of the electron beam. If the energy of the electron beam varies significantly, that is, its energy distribution is broad, then the degree of modulation, and hence the sensitivity of the CRT device, will be decreased. However, if the energy distribution of the electron beam is relatively narrow, then relatively small voltage differences are capable of controlling or modulating the electron beam, and the sensitivity of the CRT device is improved.

If the grid structure of the CRT device were ideal and the openings or slots therethrough of infinitesimally small dimension, the slope of the characteristic curve would depend only upon the energy distribution of that component of the electron velocity which is normal to the plane of the grid element, i.e. Z-axis velocity. Electrons in a beam may have velocity components along each of the X-, Y- and Z-axes. The normal or Z-component of electron velocity depends upon several factors. First, the electrons arriving at an equal potential region of the grid elements have differing energy components, because the electrons were emitted from the cathode element with a distribution of varying energies. For example, a thermionic cathode is heated to a predetermined temperature to emit electrons whose energy levels vary in a Maxwellian distribution, that is, a negative exponential distribution in energy; on the other hand, photocathode elements are excited by incident photons to emit electrons having varying energy levels in a Dewdney distribution. Thus, electrons emitted from either type of electron source arrive at the equal potential region of the grid element with differing energy levels since they were originally emitted from their cathode with a distribution of energy levels. Secondly, even though electrons are emitted with the same initial energy level, all electrons are not emitted in the same direction and are typically emitted in varying directions in accordance with a Lambertian distribution. Thus, since electrons having a velocity component transverse to the X-axis, must necessarily have a lower velocity component parallel to the Z-axis, i.e. the axis normal to the grid plane, the directional variation of electrons in a Lambertian spatial distribution results in a complicated Z-axis velocity distribution. Third, the electron lenses inserted between the cathode and grid elements change the distribution of the electron energy between the X- and Y-axis transverse velocities, and the Z-axis velocities, but cannot eliminate these distributions altogether. Therefore, the Z-axis distribution of electron velocity may be made larger than that distribution at the cathode surface.

Thus, it is highly desirable that the Z-axis velocity or energy distribution of the electron beam at the target or grid element be made more narrow than that energy distribution existing at the cathode element. Typical of the prior art, electron beams of limited energy spread have been obtained by means that eliminate both the low energy and the high energy components. For example, there are mass spectrometers that eliminate both the low and high energy components of the electron beam. While these devices are effective for a focused, concentrated beam of electrons, they have the disadvantage that the total current of the electron beam is severely limited. Elimination of the low energy component has little or no effect on the energy distribution of an electron beam emitted with a Maxwellian distribution from a thermionic cathode source. Further, the elimination of the low energy component of a flood beam of electrons emitted by a photocathode element with a Dewdney distribution, reduces the energy spread, but increases the ratio of the energy spread to the photocathode response so that the resulting efficiency is very low.

In the prior art, electron velocity selector structures have been suggested as in the article entitled, "Problem of Infrared Television-Camera Tubes versus Infrared Scanners", by J. A. Hall, *Applied Optics*, Vol. X, p. 838, April, 1971, and in the article by M. Auphan et al appearing in "Infrared Physics", Vol. 3, p. 117 (1963). As described in the aforementioned articles, a velocity selector structure has been used as a direct view image converter upon which infrared radiation (IR) is directed and whereby the non-infrared radiation or a portion thereof can be eliminated. More specifically, this device includes a photoconductive IR image layer to modulate the local potential of the elements of a locally excited matrix photocathode. The electron image corresponding to the input radiation image is directed to a phosphor screen, or camera tube target, under the control of an analyzer grid having a structure similar to that of a space charge tetrode. The voltage applied to the DC analyzer grid is adjusted to discard the DC value of the signal from the coolest or least emitting objects in the field of view. The construction of such a selector as suggested by these articles is undoubtedly too complex and expensive for many applications.

SUMMARY OF THE INVENTION

It is, therefore, an object of this invention to provide an electron source for generating an electron beam that has a smaller Z-axis velocity distribution than that existing at the cathode element thereof.

It is a further object of this invention to improve the sensitivity, response and/or control, and in particular, the current control characteristics, of CRT devices incorporating the improved electron source of this invention.

In accordance with the teachings of this invention, there is disclosed an electron source for providing an electron flow whose variation of energy levels or velocities along its Z-axis is relatively small. In particular, the electron source of this invention includes a suitable cathode element for generating electrons and a mirror element for substantially eliminating the high energy component of the electrons. In one illustrative embodiment of this invention, a substrate is provided upon which is disposed a material having a low secondary electron emission ratio. Incident electrons with an energy level lower than a predetermined critical value are reflected away, while those electrons exceeding the aforementioned critical value are absorbed by the low secondary electron emissive material. As a result, the reflected electrons form a beam of electrons in which the high energy component is substantially eliminated. The critical energy value is dependent upon the voltage difference between the mirror element and the cathode element.

Significantly, the teachings of this invention are applicable to both narrow or pencil beams of electrons, and to flood beams of electrons. For example, an electron source in accordance with the teachings of this invention may be incorporated into a display storage tube. The mirror element incorporated into the display storage tube may include a convex substrate coated with a secondary emissive material. Such a velocity selector mirror is disposed to intercept the electron beam that is focused to form a real image. The convex mirror element forms in turn a virtual image which is quite small, and the electrons reflected by the mirror will be directed radially with a very small energy distribution. Next, a collimating electron lens is used to focus the reflected electrons to an image at infinity to direct a flood beam of electrons of narrow energy distribution along the Z-axis onto a storage grid.

In a further embodiment of this invention, a narrow or pencil beam of electrons is formed with the use of a substrate and a secondary emissive material that are substantially flat. Illustratively, the selector mirror assembly of this further embodiment is disposed at the crossover of a first electron lens associated with the cathode element, and a second or focusing electron lens uses the flat reflector assembly as an object and forms an image of the electrons reflected therefrom at a target element, e.g. a photoconductive target of a TV camera tube such as a Vidicon. This results in a focused electron beam with a narrow spread of Z-axis electron energies despite the angle of convergence at the focused spot, particularly if this angle of convergence is nearly equal to the angle of divergence from the mirror.

BRIEF DESCRIPTION OF THE DRAWINGS

These and other objects and advantages of the present invention will become more apparent by referring to the following detailed description and accompanying drawings, in which.

DESCRIPTION OF THE PREFERRED EMBODIMENTS

Figure 1A:
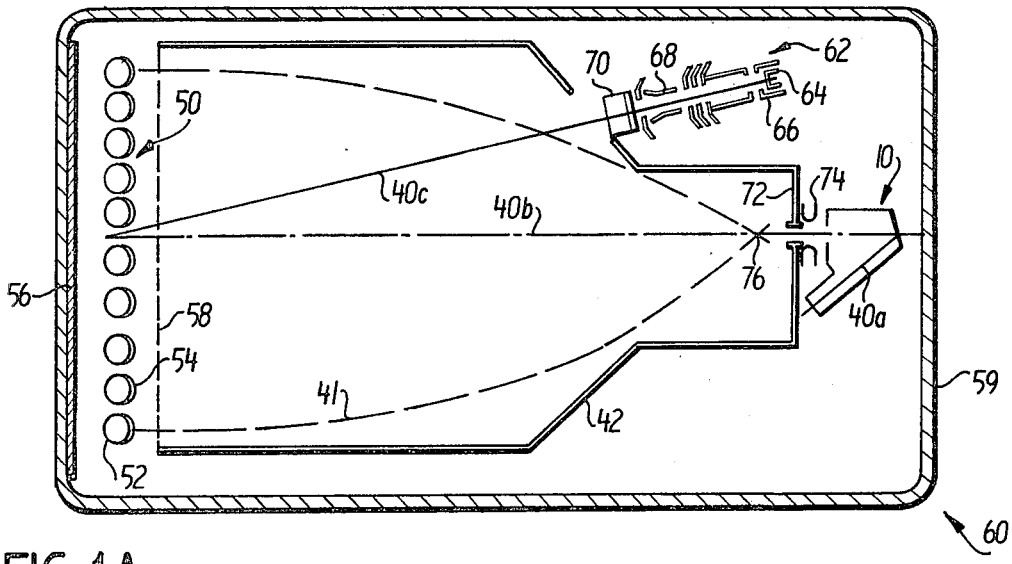
FIGS. 1A and 1B are sectioned views, respectively, of an image storage-display device, and an electron source to be incorporated therein for providing a flow of electrons having a narrow energy distribution in accordance with the teachings of this invention.
Figure 1B:
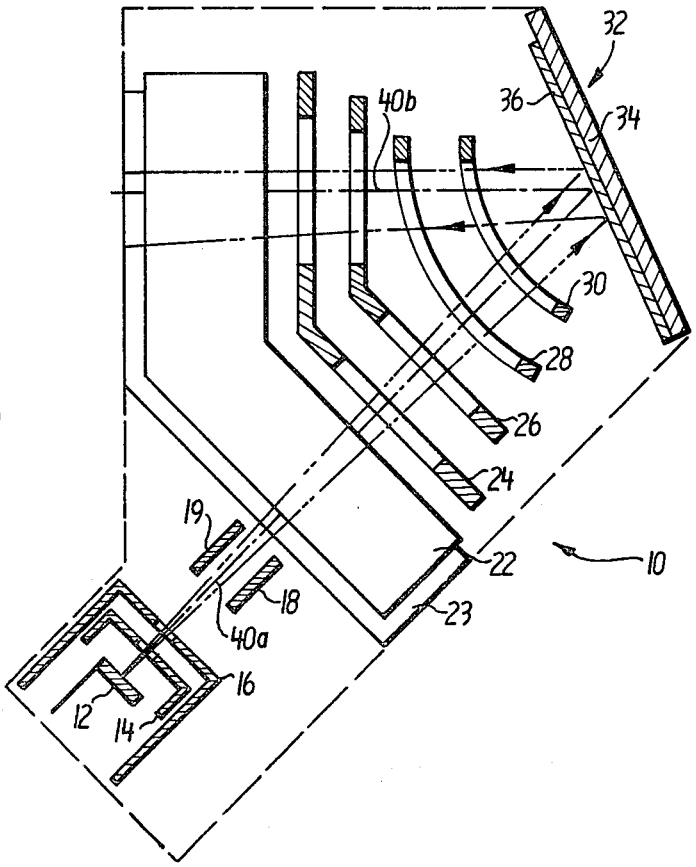

With regard to the drawings and, in particular, to FIG. 1A, there is shown a source or electron gun assembly 10 in accordance with the teachings of this invention for providing a beam of electrons with a substantially uniform energy component. In particular, there is shown in FIG. 1B a cathode element 12, typically of the thermionic type, for generating a Maxwellian distribution of electrons. The emitted flow of electrons is successively accelerated by a $G_1$ electrode 14 and a $G_2$ electrode 16. First and second X-alignment plates 18 an 19, and first and second Y-alignment plates 22 and 23 are disposed successively about the resulting beam of electrons. In succession, a plurality of accelerator electrodes 24, 26, 28 and 30 are disposed between the Y-alignment plates 22 and 23, and an energy selector or mirror element 32 in accordance with the teachings of this invention. The beam of electrons emitted from the cathode element 12 is formed and directed by the aforementioned electrodes onto the surface of the mirror element 32. The cathode element 12 and the electrodes 14 to 30 form an electron gun having an axis 40*a*, whereas, the electrons reflected are formed about an axis 40*b*. The reflected beam of electrons is directed successively through the electrodes 30 and 28, the shielding plates 26 and 24, the pair of Y-alignment plates 22 and 23 to be directed then onto a target element.

In accordance with teachings of this invention, the energy selector element 32, as shown in FIG. 1B, provides means for reducing the energy spread or distribution of an electron beam by eliminating the electrons of high energy. More specifically, the energy selector element 32 absorbs the high energy electrons, but reflects those electrons of low energy. In particular, the energy selector element 32 comprises an electrically conductive electrode or substrate 34 which is disposed at a negative potential with respect to the cathode element 12 and a layer or member 36 made of a low secondary emissive material. The energy selector element 32 in this embodiment may be thought of as an electron mirror. A selected potential difference is applied between the cathode element 12 and the substrate 34 of the energy selector element 32 such that the potential at the surface of the secondary emissive material is set in a manner to be explained in detail later, at a critical value slightly negative with respect to the cathode surface potential of the cathode element 12. More specifically, the potential at the surface of the secondary emissive material is set below the first crossover of the secondary emissive material with respect to the cathode potential. As a result, those electrons with sufficiently high energy strike the surface of the secondary emissive layer 36 and are absorbed. As indicated by the arrows in FIG. 1B, those electrons whose energy level is lower than the critical value are reflected away to form the beam of electrons along the axis 40*b*. Thus, only the low energy component remains in the reflected beam of electrons, while the high energy component is absorbed by the layer 36.

Figure 5:
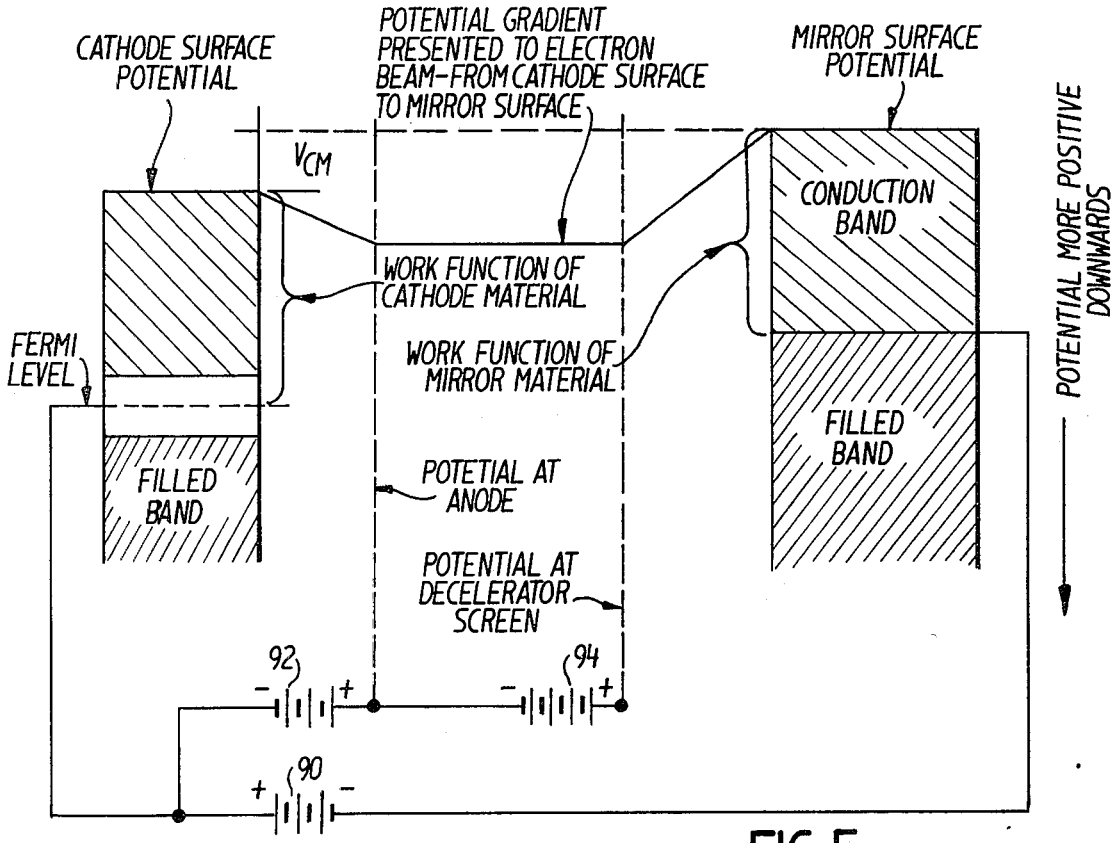
FIG. 5 is a graphical representation of the potential gradient of the flow of electrons from the cathode surface to the surface of the mirror element of a device such as that shown in FIGS. 1A and B, 2, and 3A and B.

The critical value is related to the voltage difference between the energy selector element 32 and the cathode element 12, as will now be explained with reference to FIG. 5, which illustrates the potential gradients presented to the electron beam as it is accelerated from the surface of the cathode element 12 to the surface of the secondary emissive layer 34. The potential at the surface of the cathode element 12 is determined by several factors, including the potential of a source 90 which is connected to the cathode element 12, as well as the work function of the cathode material. More specifically, as illustrated in FIG. 5, wherein according to custom potential is plotted vertically, the more positive potentials being shown lower on the diagram, the potential of the battery 90 sets the Fermi level with the potential of the cathode surface being set at a relatively small negative voltage with respect thereto dependent upon the work function of the cathode material. As electrons are emitted from the cathode surface, they are subject to the influence of the potentials established upon the anode element 16 and the decelerator electrodes, only one of which is illustrated in FIG. 5. The potential sources 92 and 94 determine the potential fields established by the anode element 61 and the decelerator electrode 24. As shown in FIG. 5, the electrons, as they pass the last decelerator electrode, are decelerated onto the surface of the secondary emissive layer 36 with a potential set to the critical value $V_{CM}$ with respect to that of the cathode surface potential. As indicated in FIG. 5, the mirror surface potential is determined by the potential applied by source 90 to the substrate of the mirror element 32 to set thereby the Fermi level of the secondary emissive material, as well as the work function of the secondary emissive material of layer 36. Thus, FIG. 5 demonstrates diagrammatically how the surface potential of the cathode and mirror elements are set in terms of their respective electron energy level diagrams, and the potential gradients established between the surface of the cathode element 12 and the surface of the secondary emissive layer 36.

Illustratively, the secondary emissive material of the layer 36 may be either a metal or a semiconductive material having the required low secondary emission ratio and also being suitable for being disposed within the high vacuum of the CRT devices contemplated. In FIG. 5, the band structure shown for the mirror is that of a metal. Typically, such materials must not contaminate the environment of the vacuum established within the CRT device and also must perform the desired function in accordance with the teachings of this invention. In a particular illustrative embodiment of this invention, one of the noble metals, e.g. gold, platinum or rhodium, is deposited upon the substrate 34 as a smoke layer having a density less than 20% of that material in its bulk form. Preferably, the metal is deposited to a density in the range of 2% to 5% of the particular material in its bulk form. In one illustrative embodiment of this invention, gold was chosen as the secondary emissive material and was deposited as a low-density layer 36 having a density in the preferred range of 2% to 5% of the bulk density of gold. For this illustrative embodiment, the potential difference between the surface of the metallic secondary emissive material and the surface cathode potential is set in the order of 0.1 volts. If a semiconductive material is employed in layer 36, the potential difference between the Fermi level of the semiconductor secondary emissive material and the Fermi level of the cathode potential will be different because the work function of the semiconductor is different, but the potential difference between the surfaces will be the same, in the order of 0.1 volts, the mirror surface being the more negative.

The axis of the beam of electrons 40*a* should approach the surface of the layer 36 as nearly normal as possible. In all electrostatic lens designs, some compromise must be made so that the reflected beam 40*b* does not strike the electrodes of the gun, such as the grids 14 and 16, and the cathode element 12. Typically, a small coil may be used for providing a transverse magnetic field to bend the axis of the beam 40*a* of electrons; such a magnetic field has been previously used with electron mirrors for other purposes.

Significantly, the electron source of this invention is capable of generating narrow or pencil electron beams and also of generating flood or wide angle beams of electrons. With regard to FIGS. 1A and 1B, the electron gun assembly 10 is adapted illustratively to generate a flood beam of electrons and is incorporated into the display storage device 60 as shown in FIG. 1A. Though only the outline of the electron gun assembly 10 is shown in FIG. 1A, it is understood that the elements thereof are configured and are operative as explained and shown with regard to FIG. 1B. In brief, the electrons are emitted by the cathode element 12 to be accelerated onto the surface of the secondary emissive layer 36 of the mirror element 32, whereby the electrons whose energy level is above a predetermined critical value, are absorbed and the electrons of a lower energy level are reflected to form a flood beam about the axis 40*b*. The electrons reflected from the substantially flat surface of the secondary emissive layer 36 diverge, and appropriate converging electrodes are disposed about the axis 40b for bringing the electrons to a point of convergence 76.

Further, the electron gun assembly 10 is disposed within an envelope 59 and includes a set of collimating electrodes 42 as is well known in the art for collimating the electrons passing through the point 76 of convergence into a flood beam of electrons directed along paths as indicated by the numerals 41 substantially parallel to each other. The collimated flood beam of electrons is directed through a deceleration screen 58 and a storage target 50 onto a luminescent display screen 56, whereby the image stored upon the target 50 is visually displayed. An image is written onto the target 50 by a write electron gun 62 comprised of a cathode element 64, an anode element 66 and appropriate vertical and horizontal deflection plates 68 and 70. Briefly, a video signal is applied to the write electron gun 62 to modulate the electron beam as it is scanned by the plates 68 and 70 across the face of the target 50 to write thereon a charge pattern to be stored. Illustratively, the target 50 is made up of a screen 52, shown in cross-section in FIG. 1A, and a storage material 54 deposited on that side of the storage target facing the electron gun assembly 10. The electron gun assembly 10 thus provides a read flood beam of electrons which is modulated by the charge pattern stored upon the storage material 54 of the target 50 as it passes through the screen 52; in turn, the modulated beam of electrons is directed upon the luminescent screen 56 for displaying the stored image. For a more complete description of at least one illustrative embodiment of the structure and method of operation of a display storage device, reference is made to U.S. Pat. No. 3,088,048, assigned to the Assignee of this invention.

Figure 2:
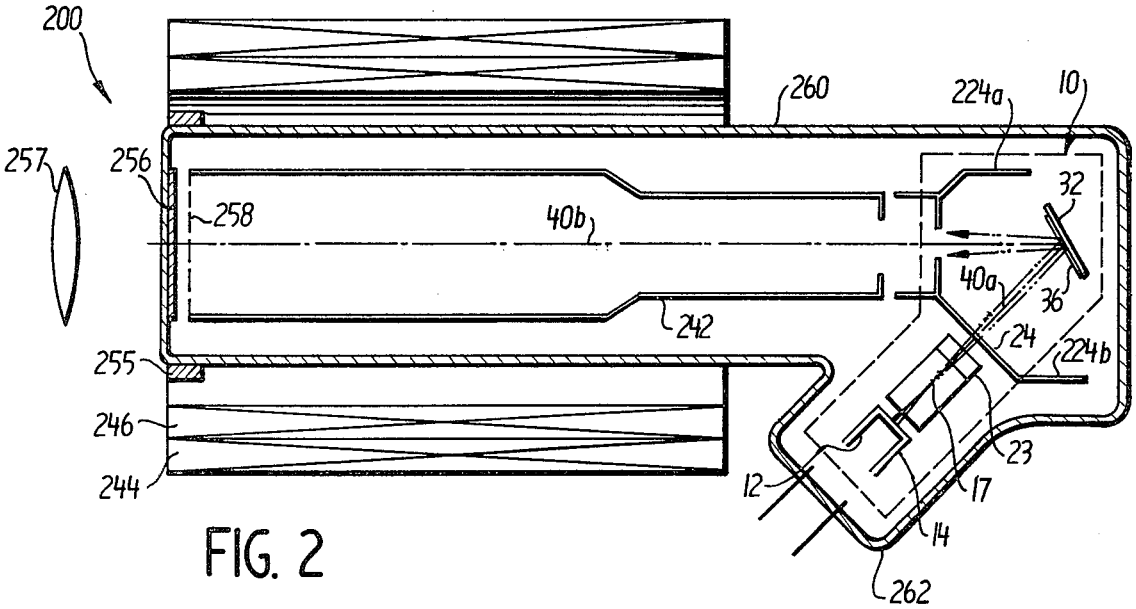
FIG. 2 is a sectioned view of a television camera device such as a Vidicon, incorporating the source of electrons as shown in FIG. 1B.

With regard to FIG. 2, there is shown a television camera device 200 similar to a Vidicon tube for providing a video signal corresponding to a radiation image focused as by a lens assembly 257 onto a photocathode element 256 of the TV camera device 200. The video signal is read from the photocathode element 256 by a pencil or narrow beam of electrons formed by an electron gun assembly 10, as shown in FIG. 1B. In particular, the incident radiation image serves to establish a corresponding charge pattern upon the photocathode element 256, which is stored thereon and which is read out by the incident read electron beam form the electron gun assembly 10. The electron beam is generated in a manner as described above with regard to FIG. 1B. Further, the TV camera device 200 includes a wall electrode 242 and a decelerating grid 258 disposed in a substantially parallel relationship with the surface of the photocathode element 256. In addition, a focusing coil 244 is disposed about the envelope 260 to direct normally the read beam of electrons onto the surface of the photocathode element 256. Deflection coils 246 are also disposed about the envelope 260 to deflect the read beam of electrons in a raster across the surface of the element 256 to thereby provide a video signal from an output terminal 255 coupled with the photocathode element 256.

In the illustrative embodiment shown in FIG. 2, the $G_1$ electrode 14 serves as a part of an electron gun triode for focusing the electrons emitted from the cathode element 12 to form a virtual crossover 17 with a minimum distribution of transverse velocities, at a point immediately in front of the $G_1$ electrode 14. The remaining electrodes 23 and 24, as shown in FIG. 2, disposed between the virtual crossover point and the energy selector element 32′ serve as a first electron lens for forming an image of the crossover in the vicinity of the energy selector element 32′, i.e. either immediately in front of or behind the element 32′. In a preferred embodiment of this invention, the surface of the secondary emissive layer 36′ is substantially planar in order to form a pencil beam of electrons. As above, the energy selector element 32′ serves to reflect electrons of a narrow energy distribution to be focused into a narrow beam. A focusing lens is formed by the wall electrode 242 as well as the focusing coil 246 to use the image as formed by the first electron gun at the energy selector element 32′ as an object, and to focus this object as an image at the surface of the photocathode element 256. Thus, the selection of only the low-velocity components by the energy selector element 32′ results in a pencil beam of electrons with a minimum spread in the distribution of axially directed velocities so that the incident electron beam has increased sensitivity to the charge pattern established on the cathode element 256. For a more complete description of the cathode apparatus and method of operation of a TV camera device such as a Vidicon, reference is made to the discussion entitled, "Photoconductive-Target Tubes" beginning at p. 368 of *Electronic Image Storage*, Kazan & Knoll, Academic Press, 1968.

Figure 3A:
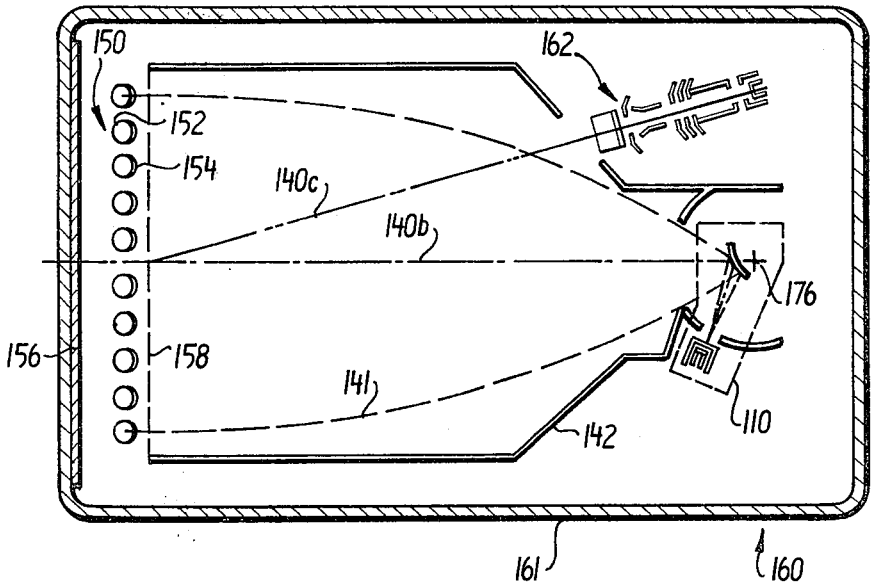
FIGS. 3A and 3B are sectioned views, respectively, of an image storage-display device, and an electron source in accordance with a further embodiment of this invention to be incorporated therein.
Figure 3B:
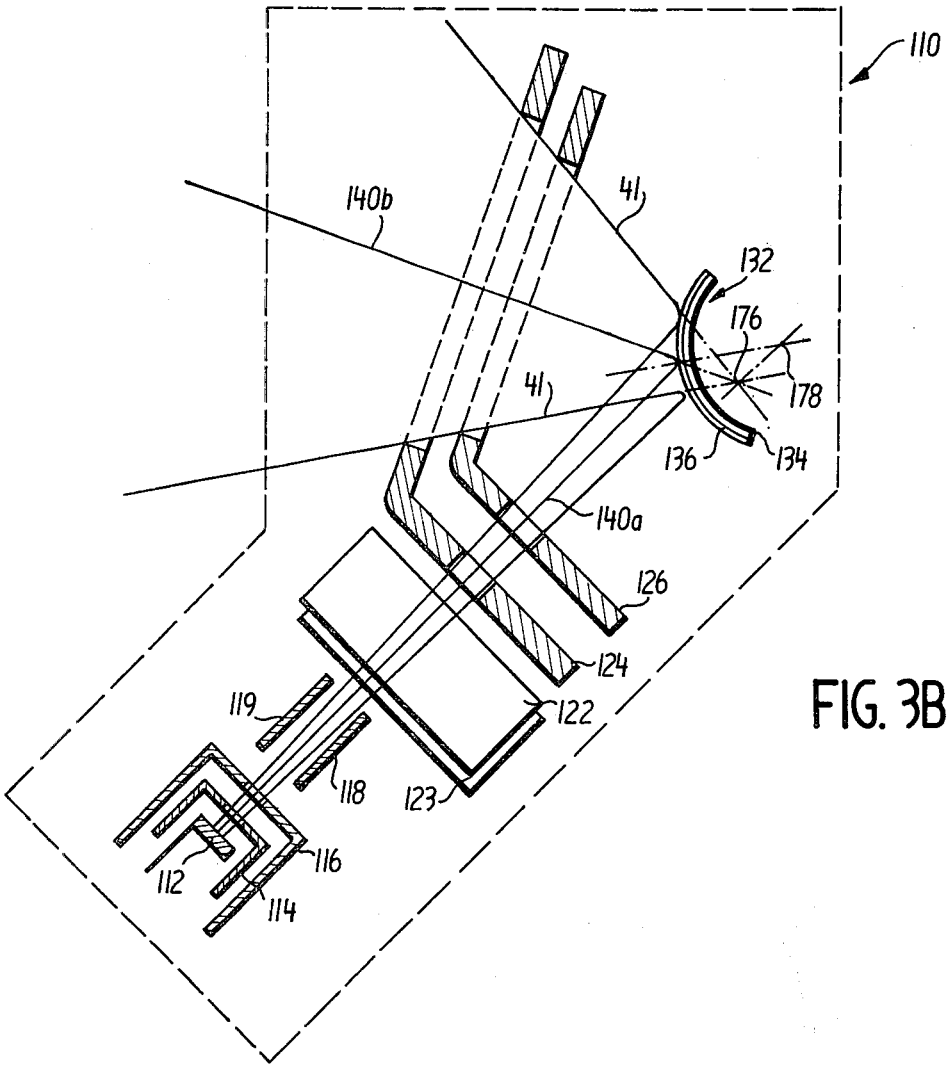

In the illustrative embodiment of the display storage tube shown in FIG. 1A, the electron gun assembly 10 as incorporated therein includes a selector element 32 having a secondary emissive layer 36 whose surface is substantially flat. The electrons reflected from the surface of the secondary emissive layer 36 diverge and additional electrodes are required to converge the reflected electrons through a cross-over point. As a result, additional electrode structure and length are required for such a storage display tube. In a preferred embodiment of this invention, an electron gun assembly 110 as illustrated in FIG. 3B is incorporated into a display storage device 160 as shown in FIG. 3A. The elements of this embodiment are similar to those shown in FIGS. 1A and 1B and are numbered similarly in the 100's. With regard to FIG. 3B, the electron gun assembly 110 includes a cathode element 112 for emitting electrons, and $G_1$ and $G_2$ electrodes 114 and 116 for forming a virtual crossover located well behind the cathode 112, with a minimum distribution of transverse velocities within the electron beam. In accordance with this preferred embodiment, the selector element 132 includes a substrate 134 and a layer 136 of convex configuration, which is disposed to intercept the electron beam so formed before they reach this real image. Thus, the convex mirror or selector element 132 forms a virtual image which is quite small. If the virtual image is quite small and particularly if the electric field adjacent to the surface of the secondary emissive layer 136 is high, substantially all electrons are reflected radially therefrom, with a very small distribution in transverse (azimuthal) velocity.

As shown in FIG. 3B, the electron gun formed by the cathode element 112 and electrodes 114 to 126 has an axis **140*a* along which the electron beam is directed onto the convex selector element 132. In turn, the reflected beam is formed by the electrodes 126 and 124 about an axis 140*b*. To properly position the convex selector element 132 so that there will be sufficient angle between the axes 140*a* and 140*b*, the focus point 176 of the reflected image through which the axis 140b passes, is offset from the center 178 of curvature of the convex selector element 132, as shown in FIG. 3B. Further, the focus point 176 is disposed a distance from the surface of the selector element 132** equal approximately to one-half of the radius of curvature thereof.

With regard to FIG. 3A, the electron gun assembly 110 is disposed within a envelope 161 for directing a flood beam centered about axis 140b through a storage target 150 similar to that as described above with regard to FIG. 1A, onto a luminescent screen 156. More specifically, the set of collimating electrodes 142 acts as a collimating electron lens to focus the reflected electrons to an image at infinity, i.e. the rays are collimated to be substantially mutually parallel as indicated by the outline 141 of the flood beam so that they are incident normal to the surface of the storage target 150. Thus, as a result of efficient collimation of the flood beam of electrons so that the transverse velocity distribution is minimized and of the selection of only lowvelocity components by the selector element 132, the resultant flood beam has a minimum speed in the distribution of axially directed velocities. Therefore, as will be more fully explained, the flood beam has an increased sensitivity to the voltage pattern stored upon the target 150.

Figure 6:
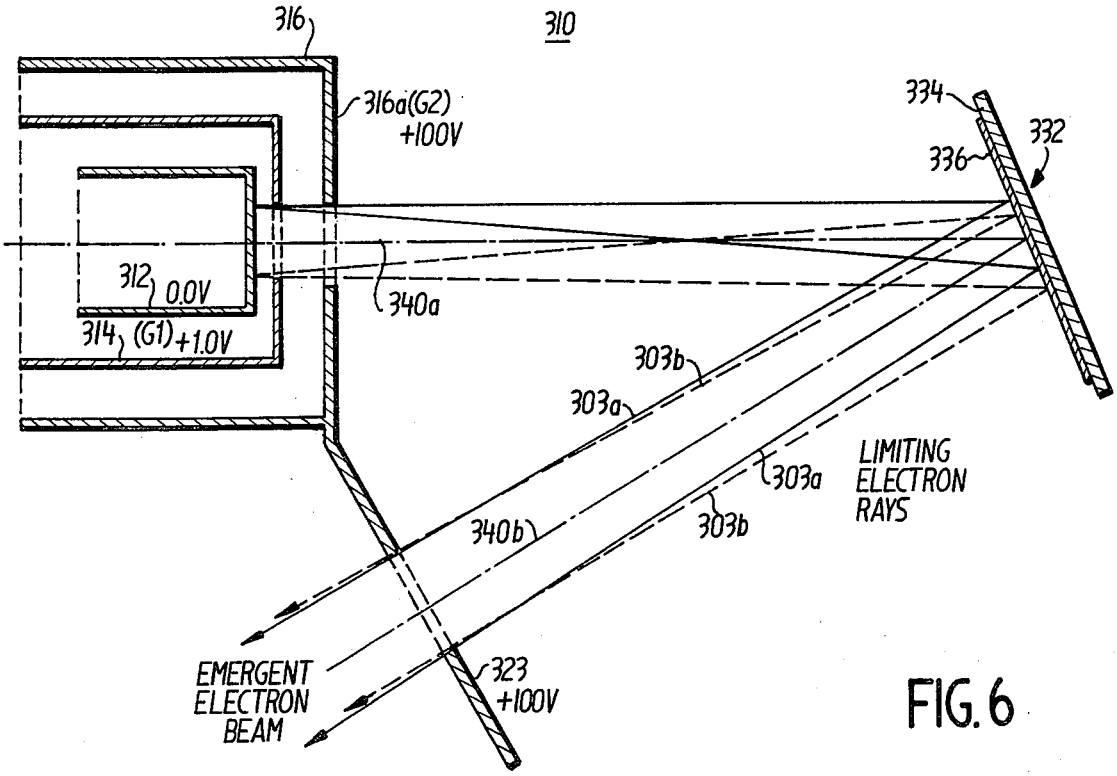
FIG. 6 is a sectioned view of an electron source in accordance with a further embodiment of this invention.

In the illustrative embodiment of the electron gun 10 shown in FIG. 1B, there is shown a configuration including a plurality of electrodes 14 to 30 for forming and directing the electron beam. However, it is contemplated that the electron gun assembly in accordance with teachings of this invention may be constructed utilizing a minimum number of electrodes, as shown in the embodiment of FIG. 6. Using corresponding numbers in the 300's to identify similar elements in FIG. 6 to those as shown in FIG. 1B, a cathode element 312 emits electrons which are formed by $G_1$ and $G_2$ electrodes 314 and 316 into a beam about axis 340a to be directed onto a selector element 332. As shown in FIG. 6, the selector element 332 includes a substrate 334 and a layer 336 of secondary emissive material of substantially planar configuration. The reflected electrons are formed into an emergent electron beam about axis 340b by a shield aperture electrode 323. In this simplified design, the selector element 332 is located accurately to be perpendicular to the bisector of the angle between the electron optic axes 340a and 340b. Whereas the $G_2$ electrode 316 takes the form of a cylindrical element with an aperture cup 316a secured thereto, the shield aperture electrode 323 takes the form of a plate bent at an angle as shown in FIG. 6 to which the grid assembly is attached, so that the shield aperture electrode 323 forms a positive electrode of a nearly spherical symmetric deceleration electric field between it and the selector element 332. In one illustrative embodiment of this invention, the electron gun assembly has an overall length parallel to the electron axis 340a of about 0.8 inch and a width perpendicular to the axis 340a of about 0.6 inch.

Figure 4:
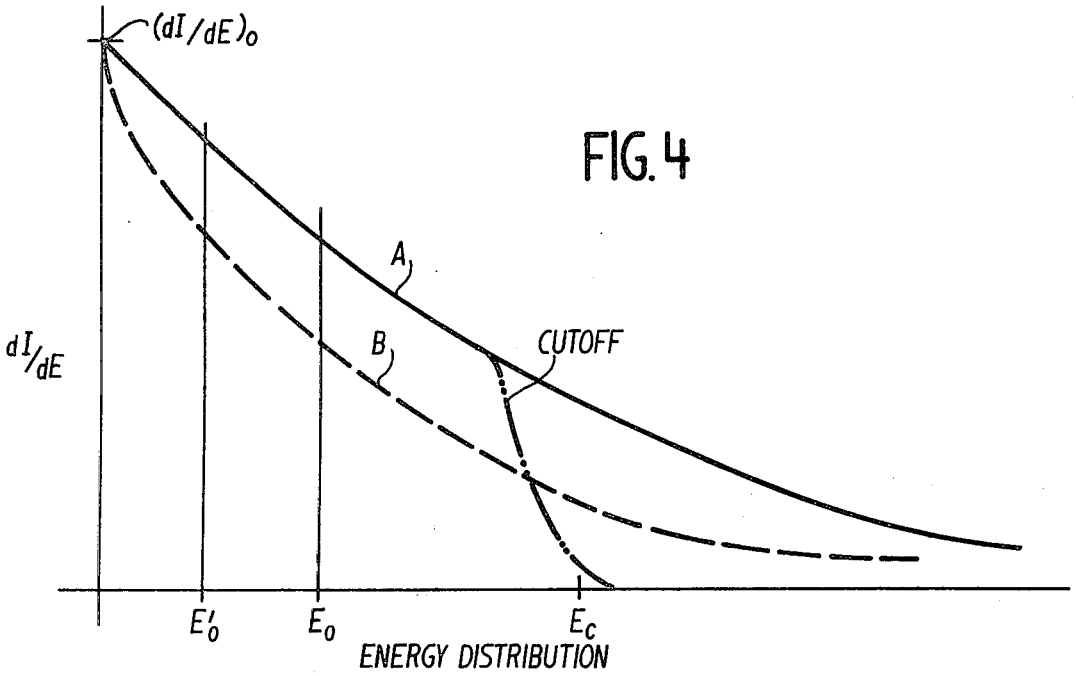
FIG. 4 is a graphical representation of the energy distribution in a flow of electrons before and after the high-energy components have been removed in accordance with the teachings of this invention.

As explained above, the selector element serves to eliminate that portion of the electron beam of high energy electrons and to reflect only those electrons having energy levels below a selected critical value. An electron beam with such a narrow energy distribution may be used in a display storage tube or a TV camera device such as a Vidicon, as described above, to increase the transconductance $g_m$ of such a device. As a result, the control or sensitivity of the target element incorporated therein is increased as compared to the sensitivity of a device with an electron beam of a wider energy distribution. As shown in FIG. 4, the energy distribution of electrons in an electron beam is closely Maxwellian, that is exponential, the current per unit energy interval at energy $E(E = eV)$ can be expressed:

$$\frac{dI}{dE} = \left(\frac{dI}{dF}\right)_o \exp^{-E/E^o} \quad (1)$$

were $E_o$ is the average energy of the electrons of the beam (typically in the order of 0.2 eV for the usual carefully formed, unfocused electron beam), and $$\left(\frac{dI}{dE}\right)_o$$

is the current per unit energy interval for electrons of zero energy. The total current $I_o$ of the electron beam is calculated by integrating the area underneath the curve over all electrons:

$$I_o = E_o \left(\frac{dI}{dE}\right)_o \quad (2)$$

A control target such as the storage screen of a display storage tube or the photocathode element of a Vidicon tube acts to reflect the low energy electrons and pass the high electrons; hence, it sets the upper limit of integration. Thus, for a theoretically ideal control screen, the value of the upper limit of integration is determined sharply at E; however, a practical control target has a finite voltage spread function which must be convoluted with the energy distribution before intergration. The transconductance $g_m$ is simply proportional to the slope of the energy distribution at the value of the control screen potential and is represented as follows:

$$g_m = e\left(\frac{dI}{dE}\right) = \left(e\ \frac{I_o}{E_o}\right) \exp^{-E/E^o} \quad (3)$$

Thus, it is seen from equation (3) that the transconductance $g_m$ is inversely proportional to the average electron energy $E_o$.

Examination of the above equations (1), (2) and (3) indicates that the narrowing of the energy distribution by the removal of the fraction of current containing the slow or low-energy electrons simply reduces the total current and changes neither the transconductance $g_m$ nor the energy distribution of the electron beam.

However, consideration of the aforelisted equations does not indicate what effect upon the transconductance $g_m$ is produced if that portion of the current having the fast or high-energy electrons is removed. With regard to FIG. 4, an explanation will be given now as it is presently understood of the effect of removing the high-energy electron components of the electron beam upon the transconductance $g_m$ of the control target. A further discussion of the derivation and significance of the energy distribution curve as shown in FIG. 4 is found in "Discharging an Insulated Surface by Secondary Emission Without Redistribution", Dr. Arthur S. Jensen, *RCA Review*, June 1955, and at pages 23 and 24 of *Electronic Image Storage* by Kazan & Knoll, Academic Press (1968). In FIG. 4, the solid curve denoted by the letter "A" is indicative of the incremental current or number of electrons per unit of energy, whereas the value indicated by the notation $E_o$ indicates the weighted average of the energies of the electrons within this electron beam. If, in accordance with teachings of this invention, the high-energy of fast portion of the electron beam above a critical value (as shown in FIG.

4) is eliminated as by imposing the selector or mirror element of this invention in the path of the electron beam, the reflected electrons initially will have an energy current distribution indicated by that portion of the curve indicated by the letter A and the dashed portion indicated by the notation "cut-off". The average energy distribution of those electrons immediately adjacent to the surface of the selector element remains substantially $E_o$. However, electrons in a beam of reasonable current density (for example, more than one microampere per square centimeter) are on the average not very far apart (for example, about 0.5 mm), so that the space charge repulsion results in a change of electron energy at a reasonable rate as the electrons are directed away from the surface of the selector element and toward the surface of the control target. For example, the change of electron energy would minimally be in the order of 0.1 mV/mm of electron travel. Hence, during the passage of the electron beam from the surface of the mirror element to the control target, the space charge interaction introduces enough turbulence in the beam current flow that thermal equilibrium is re-established, and its energy distribution again is nearly Maxwellian (exponential), but with a smaller average energy $E_o'$ per electron and a higher transconductance. With regard to FIG. 4, the energy distribution of the reflected electron beam after it has traveled a sufficient distance from the surface of the selector element is represented by the dashed curve "B" and its average energy per electron is reduced to a value indicated by $E_o'$. Thus, if two electron beams of the same total current are compared and one has had all electrons with energy greater than $E_c$ removed, it can be show that after thermal equilibrium has been re-established in the beam, the average energy $E_o'$ per electron is less by the ratio $(1 + c/a)$ and the transconductance $g_m$ is greater by the ratio $a/(a + c)$, where:

$$a = 1 - \exp^{-E^c/E^o} \quad (4)$$

and $$c = -(E_c/E_o)\exp^{-E^c/E^o} \quad (5)$$

In an illustrative example for $E/_cE_o = 0\ 0.5$, the narrow energy distribution electron beam requires a cathode current greater by 2.54; regardless of the higher current required, the average electron energy is reduced by a factor of 0.23 and the transconductance of its target is increased 4.36.

In the storage display tube and the Vidicon tube described above, the distance between the surface of the selector element and the surface of the control target is illustratively in the order of 150 mm, which allows more than sufficient electron travel to permit the redistribution of the electron energy distribution so that the incident beam electrons has an energy distribution in accordance with curve B of FIG. 4.

Numerous changes may be made in the above-described apparatus and the different embodiments of the invention may be made without departing from the spirit thereof; therefore, it is intended that all matter contained in the foregoing description and in the accompanying drawings shall be interpreted as illustrative and not in a limiting sense.

What is claimed is:

1. A source of electrons comprising:
   a. means for generating from a cathode surface a first flow of electrons having a first energy distribution;
   b. selector means comprising a substrate and a noble metal layer disposed thereon for receiving the first flow of electrons, and for absorbing electrons having energy levels above a predetermined level, which noble metal layer is formed as a low density layer having a density not greater than 20% of the noble metal in its bulk from; and
   c. potential means for applying a selected potential to said selector means to establish a potential difference between said selector means and said cathode surface whereby electrons of energy levels below the predetermined level are repelled to provide a second flow of electrons of a second energy distribution whose average energy spread is less than that of the first energy distribution.

2. A source of electrons as claimed in claim 1, wherein the density of said absorbent material is in the range of 2% to 5% of that material in bulk form.

3. A source of electrons as claimed in claim 2, wherein said material comprises gold.

4. A source of electrons as claimed in claim 1, wherein said electron receiving surface is of substantially planar configuration.

5. A source of electrons as claimed in claim 1, wherein said electron receiving surface is of a convex configuration.

6. An electron discharge device comprising:
   a. an electron source assembly including:
      1. means for generating from a cathode surface a first flow of electrons having a first energy distribution,
      2. means for providing a surface disposed to receive the first flow of electrons for absorbing selectively electrons having energy levels above a predetermined level, and
      3. means for applying a selected potential to said absorbing means to establish a potential difference between the surface of said electron receiving surface and said cathode surface whereby electrons of energy levels below the predetermined level are reflected to provide a second flow of electrons of a second energy distribution whose average energy spread is less than that of the first energy distribution;
   b. control target disposed to receive the second flow of electrons; and
   c. means for forming and directing the second flow of electrons to said control target.

7. An electron discharge device as claimed in claim 6, wherein said forming means forms the second flow of electrons into a pencil beam of electrons, and said control target comprises a photocathode element responsive to an incident radiation image for forming a corresponding voltage pattern on a surface thereof, and means for scanning the pencil beam of electrons across said surface of said photocathode element to provide a signal corresponding to the incident radiation image.

8. An electron discharge device as claimed in claim 7, wherein said receiving surface of said absorbing means is substantially planar.

9. An electron discharge device as claimed in claim 6, wherein said forming means forms the second flow of electrons into a flood beam of electrons, said control target comprises a storage grid, and there is further included a second electron source for directing a pencil beam of electrons across a surface of said storage grid to impose thereon a charge pattern whereby the flood beam of electrons is modulated in accordance with the charge pattern stored upon said storage grid, and a luminescent screen disposed to receive the modulated beam of electrons to provide a visual display thereof.

10. An electron discharge device as claimed in claim 9, wherein said receiving surface is of a convex configuration.

* * * * *